US007588354B1

(12) United States Patent
Hu et al.

(10) Patent No.: US 7,588,354 B1
(45) Date of Patent: Sep. 15, 2009

(54) RECESSED LIGHTING FIXTURE HAVING A LOCKING ASSEMBLY

(75) Inventors: Dunping Hu, Flushing, NY (US); Vincent Yang, Beihai (CN)

(73) Assignee: WAC Lighting Co., Garden City, NY (US)

( * ) Notice: Subject to any disclaimer, the term of this patent is extended or adjusted under 35 U.S.C. 154(b) by 62 days.

(21) Appl. No.: 11/962,184

(22) Filed: Dec. 21, 2007

Related U.S. Application Data

(60) Provisional application No. 60/871,405, filed on Dec. 21, 2006.

(51) Int. Cl.
*F21V 15/00* (2006.01)

(52) U.S. Cl. ..... 362/365; 362/147; 362/368

(58) Field of Classification Search ..... 362/147–148, 362/364–366, 368, 370–371, 373–374
See application file for complete search history.

(56) References Cited

U.S. PATENT DOCUMENTS 6,505,960 B2 1/2003 Schubert et al.

*Primary Examiner*—Jason Moon Han
(74) *Attorney, Agent, or Firm*—Robert W. J. Usher

(57) ABSTRACT

A recessed lighting fixture has a housing sidewall with a lip around a bottom aperture and a vertical T-slot receiving a locking assembly mounting the housing in an opening in a ceiling with the lip around a lower edge of the opening. The locking assembly has a support member with a lower strut portion and an upper attachment portion pivotally connected to a latching member. The strut portion has legs inserted through the slot so that edges of opposite walls and an axial end of a channel section base provide a U-shape line contact with the ceiling upper surface and upper teeth engage friction surfaces on opposite outside edge portions of the slot. The latching member has a handle carrying a tongue wedged between the legs by pivoting to engage locking feet with friction surfaces on opposite inside edge portions of the slot retaining the lighting fixture in the ceiling.

6 Claims, 7 Drawing Sheets

RECESSED LIGHTING FIXTURE HAVING A LOCKING ASSEMBLY

RELATED APPLICATIONS

Priority is claimed from our provisional patent application 60/871,405, filed Dec. 21, 2006, the disclosure of which is incorporated herein by reference.

FIELD OF THE INVENTION

The invention relates to a recessed lighting fixture having a locking assembly for mounting the fixture in the space above the ceiling with the light projecting downwards from the ceiling to illuminate the room below.

BACKGROUND OF THE INVENTION

U.S. Pat. No. 6,505,960 issued 2003 to Schubert et al, the disclosure of which is incorporated herein by reference, teaches a recessed lighting fixture comprises a housing comprising a sidewall extending downward to a lower housing aperture and terminating in a lip extending outwardly around at least a portion of the perimeter of the aperture, a slot in the sidewall extending away from the aperture and, at least one housing locking assembly positionable at a preselected height in the slot to clamp/mount the housing in an opening in a ceiling so that the housing extends into the space above the ceiling and the lip extends around a lower edge of the ceiling opening.

A disadvantage of the prior approach is a requirement for an additional frame resting on the ceiling surface adjacent an upper edge of the ceiling opening for sliding receipt of the housing and for clamping engagement by the locking assembly to protect the surface of the ceiling from damage from the pressure of the locking assembly when mounting the housing in the aperture.

An additional disadvantage is that the slot opens at a mouth at the bottom of the housing to admit the housing locking assembly resulting both in a weakening of a lower end of the housing and a broken lip at the lower end of the housing in direct engagement with the lower face of the ceiling which may not be visually pleasing.

SUMMARY OF THE INVENTION

Objects of the invention are to provide a recessed lighting fixture which obviates or ameliorates at least some of the disadvantages of the prior art.

According to one aspect, the invention provides a recessed lighting fixture having a locking assembly which provides an extensive edge-line engagement with a ceiling, distributing clamping force sufficiently to obviate need for an additional underlying frame to reduce contact pressure on the ceiling.

According to another aspect, the invention provides a recessed lighting fixture in which the lamp housing has a locking assembly mounting slot having a laterally enlarged portion to accommodate insertion of an enlarged portion of the locking assembly and, preferably, the enlarged portion of the locking assembly is laterally resilient permitting manual compaction to permit insertion through the laterally enlarged portion of the slot.

Such construction obviates need for the slot to open at a mouth at an edge of the housing both avoiding a consequential weakening of a lower end of the housing and enabling an unbroken lip to be provided at the lower end of the housing in direct engagement with the lower face of the ceiling for a more pleasing visual effect.

In addition, replacement of a locking assembly is possible with the housing assembly remaining in the installation position in the ceiling.

BRIEF DESCRIPTION OF DRAWINGS

In order that the invention may be readily understood, a specific example thereof will now be described with reference to the accompanying drawings in which.

DESCRIPTION OF PARTICULAR EMBODIMENT

As seen, for example, in FIGS. 4-6 and FIG. 9*a*, the recessed lighting fixture comprises a lamp receiving housing 1 and a locking assembly 2.

Figure 1:
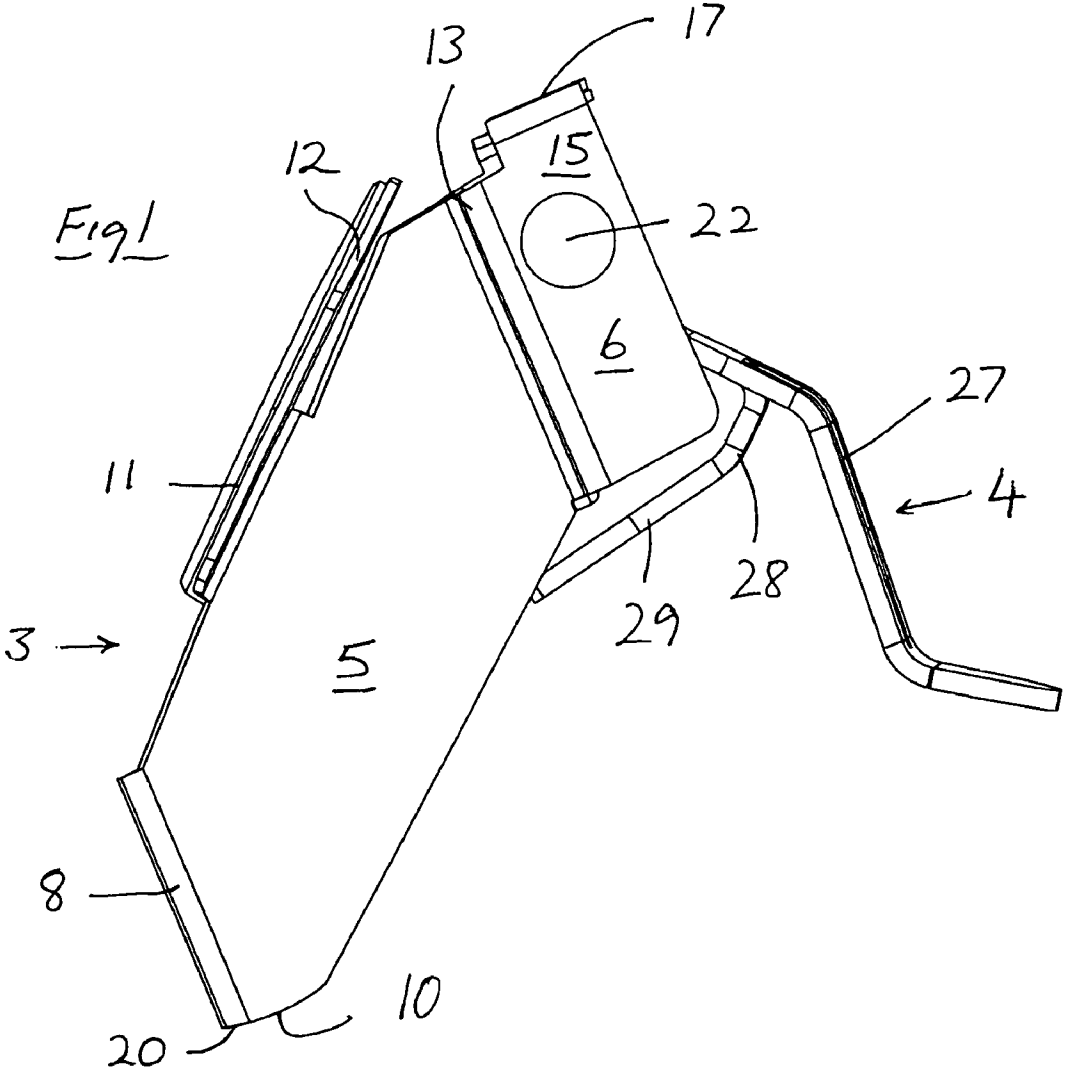
FIG. 1 is a side view of a locking assembly according to the invention.
Figure 2:
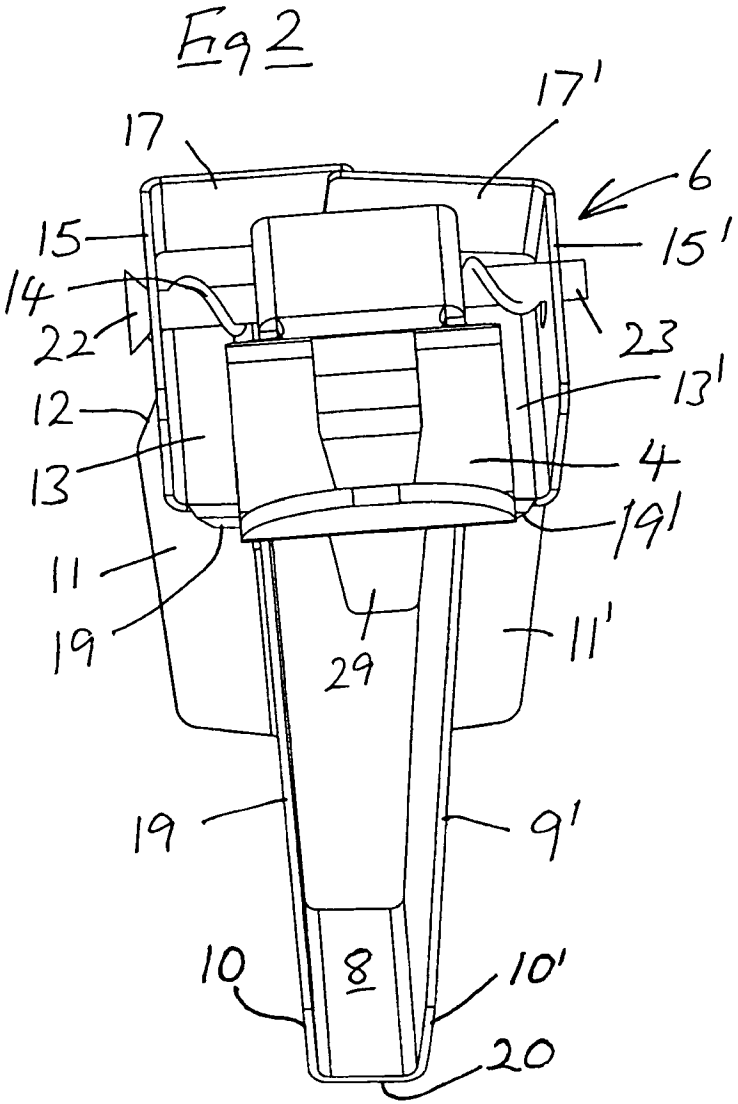
FIG. 2 is a front view of the locking assembly shown in FIG. 1.
Figure 7:
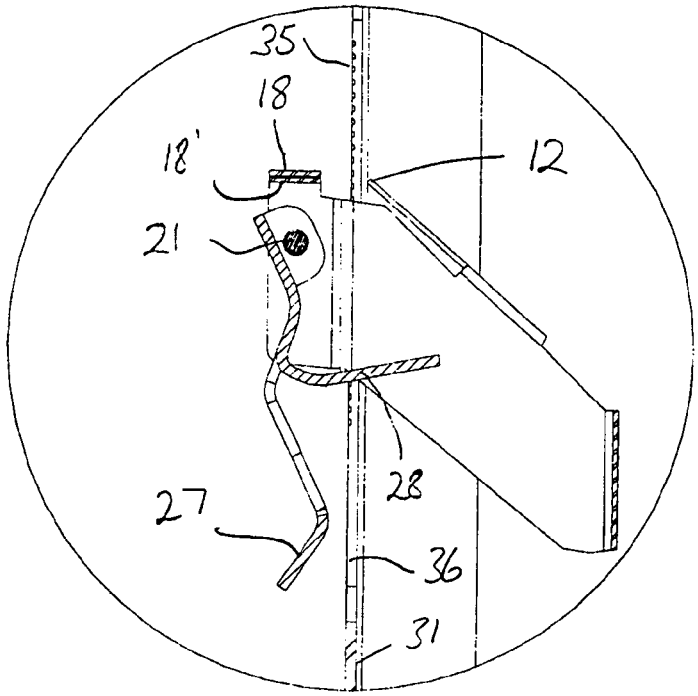
FIG. 7 is a cross-sectional view of the locking assembly inserted in the mounting slot, after the clamping step.
Figure 3:
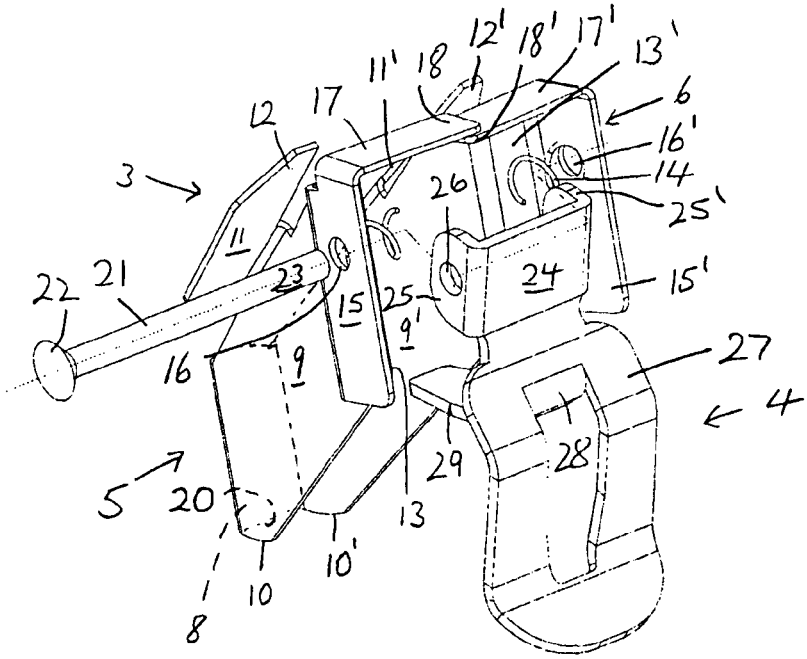
FIG. 3 is an exploded view of the locking assembly.

As shown in FIGS. 1-3, the locking assembly comprises a support member 3 pivotally connected to a latching member 4.

The support member 3 is stamped and formed from a single piece of sheet metal stock with a lower strut portion 5 and an upper attachment portion 6.

Figure 8:
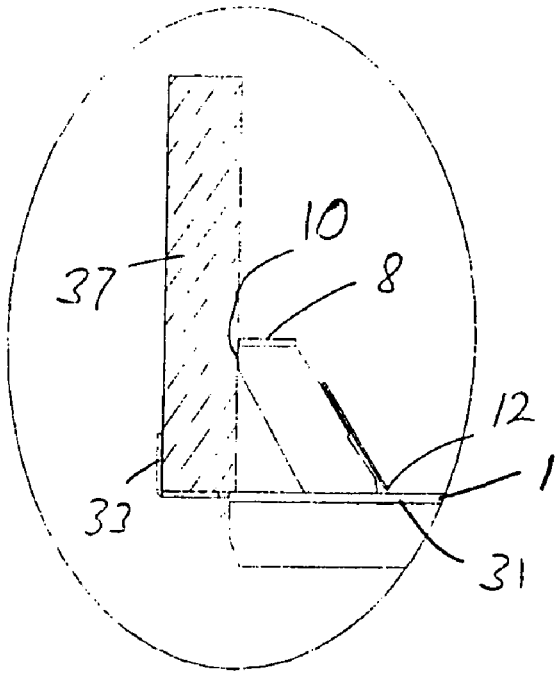
FIG. 8 is a schematic side view (rotated through 90 degrees) of the locking assembly clamping the housing in a ceiling opening; and, FIG. 9*a* is a schematic showing locking assemblies engaging the outside wall surface of a housing and the upper surface of the ceiling in locked positions so as to retain the housing extending through a ceiling openings.
Figure 9:
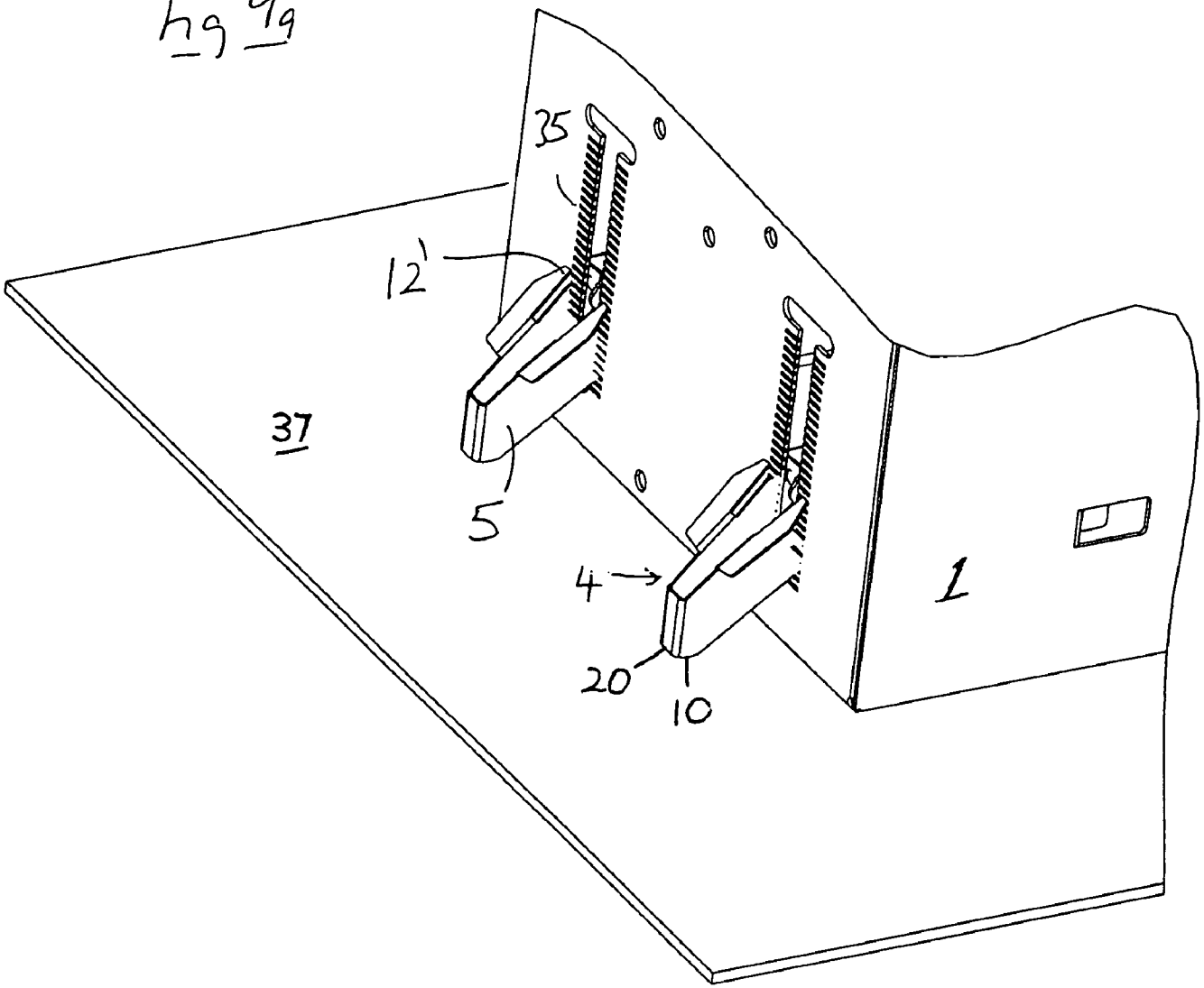
FIG. 9*b* is a schematic showing locking assemblies engaging the inside wall surface of a housing and the upper surface of the ceiling before and after locking, respectively.
Figure 9B:
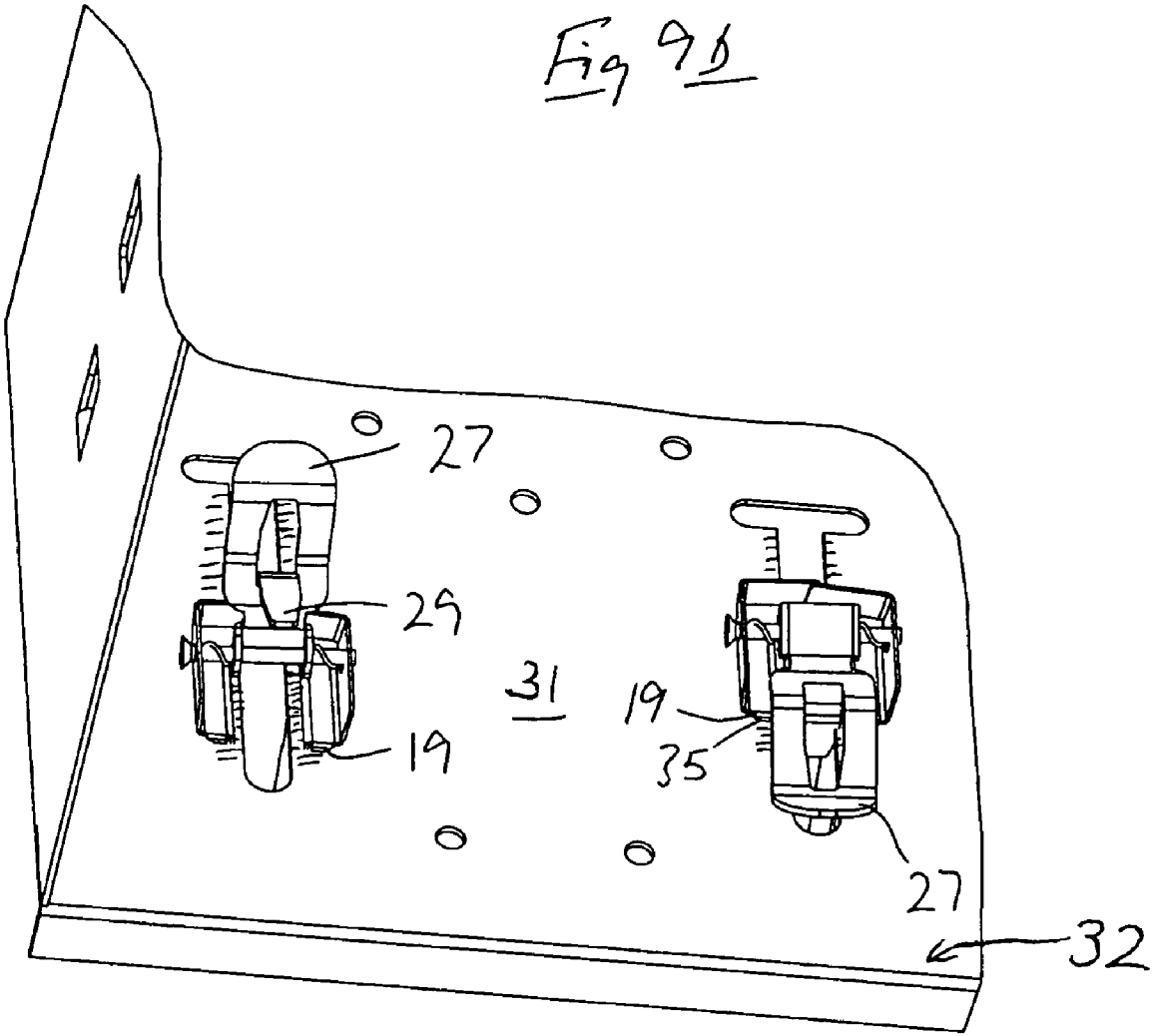

The strut portion 5 comprises a channel shape, ceiling engaging portion 7 having a base/foot 8 from opposite side edges of which a pair of leg forming, channel walls 9,9' extend upwards in divergent, face to face relation and mainly obliquely of the channel axis except for portions 10,10' of corresponding lower edges of the channel walls adjacent a lower axial end of the base 8 which extend perpendicularly to the channel axis so as to combine with a lower edge 20 of the base 8 to form a foot with a continuous, U-shape edge-line of engagement with the ceiling when clamping the housing thereagainst, as shown in FIGS. 8 and 9A. A pair of flanges 11,11' extend outwards from upper edge portions of the channel walls remote from the ceiling engaging foot and have respective flat, tapering, tooth forming extensions 12,12' protruding upwards therefrom.

The attachment portion 6 comprises a pair of flanges 13,13' extending outwards from upper ends of the leg form sidewalls, providing shoulders extending in a plane parallel to the base and having respective upwardly bent extensions 15,15' in parallel, face to face relation, having opposite, (small and large), pin receiving, through-sockets 16,16' providing a biasing spring mounting portion or yoke, having outer, rear ends of which locating tabs 17,17' are bent towards each other with free ends 18,18' overlapping in sliding engagement. Respective front edge portions of the shoulders are bent downwards to form housing locking feet 19,19.'

A pivot pin 21 has a head 22 force fitted in the small socket 16 and the shank 23 freely received in the other socket 16' so as to span the extensions 15,15'. An helical compression spring 14 is mounted axially on the pivot pin so as to bias the upper ends of the legs apart.

The latching member 4 is stamped and formed from a single piece of sheet metal stock and comprises a bracket-form land 24, opposite sides of which are formed with a pair of spaced apart, flange-form ears 25,25' having through-sockets 26 freely receiving the pivot pin.

A finger-piece or handle 27 extends from a front end of the land 14 and has a locking tongue 28 struck from a central portion, with a tapering/wedging free end 29 extending towards the legs, perpendicularly of the handle.

The housing 1 is box-like and comprises a sheet metal sidewall 31 extending downward to a lower housing aperture 32 and terminating in an outwardly extending ceiling engaging lip 33 around the perimeter of the aperture. A series of vertically extending T-shaped slots 34 are struck in the (opposite) sidewalls. Series of horizontal locking grooves 35 are provided on each side of the vertical portion 36 of each slot on both opposite faces of each of the sidewalls.

Figure 4:
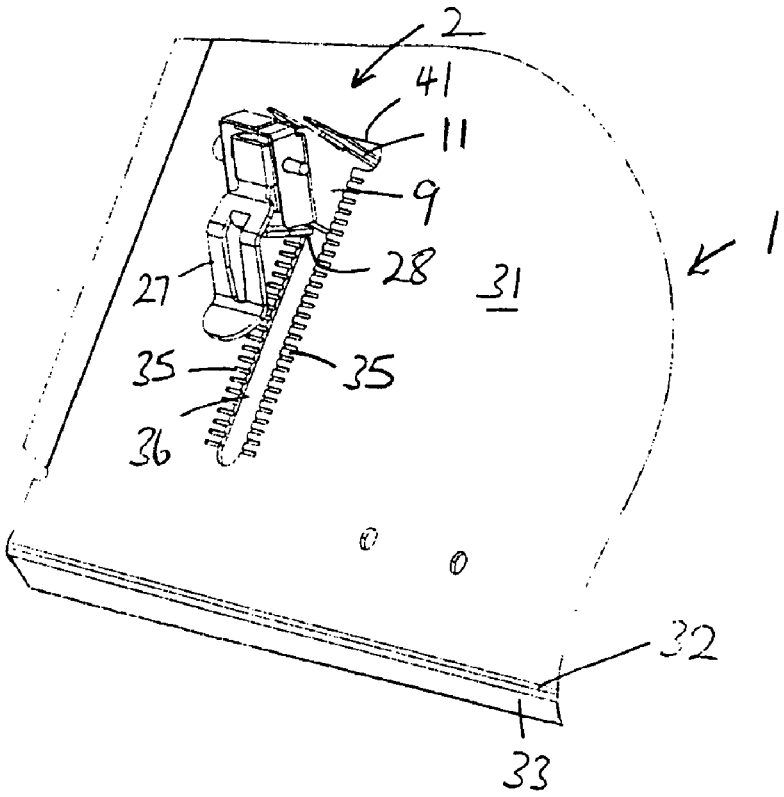
FIG. 4 is a diagrammatic perspective view of the locking assembly during insertion into a mounting slot of a lamp housing.
Figure 5:
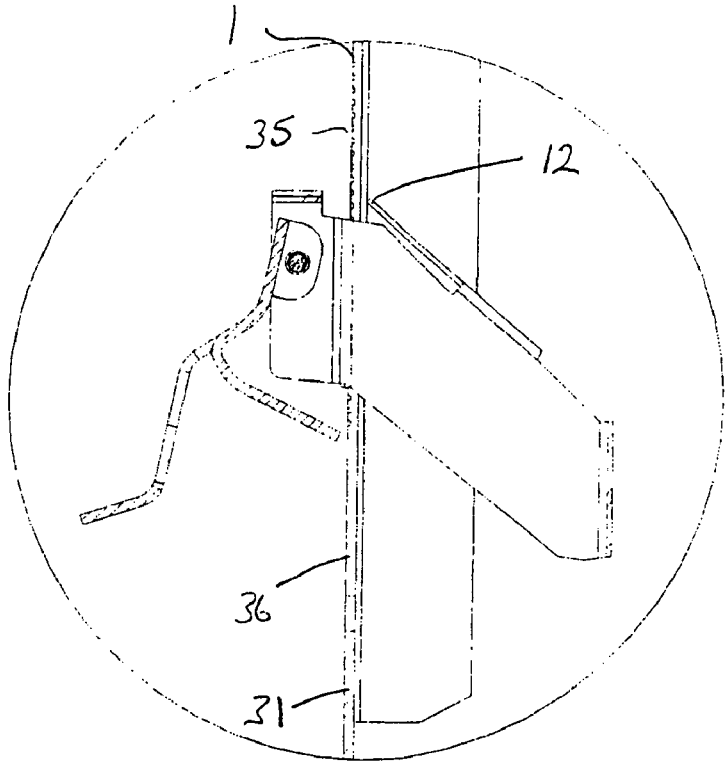
FIG. 5 is a cross-sectional view of the locking assembly inserted in the mounting slot, prior to a clamping step.

The recessed lighting fixture is installed by raising the housing through an opening in the ceiling 37, until the lip 33 engages the lower edge of the opening, partially inserting the strut forming legs 9,9' into the upper end of the slot 34, with the teeth and flanges in registration with the laterally enlarged "cross" portion 41, and manually squeezing the upwardly bent extensions 15,15' and therefore the adjacent ends of the legs together, against both their natural resiliency and the action of the compression spring 14, to permit the leg flanges 11, 11' and teeth to be inserted from the inside of the housing through the horizontal or 'cross' portion 41 of the slot with the legs passing through the vertical portion 36, as shown in FIG. 4, until the entire strut portion 5 is located on the outside of the housing as shown in FIG. 5.

The sliding engagement of the overlapping free ends 18,18' of the tabs 17,17' assists in maintaining structural integrity, resisting deformation during the squeezing action.

Figure 6:
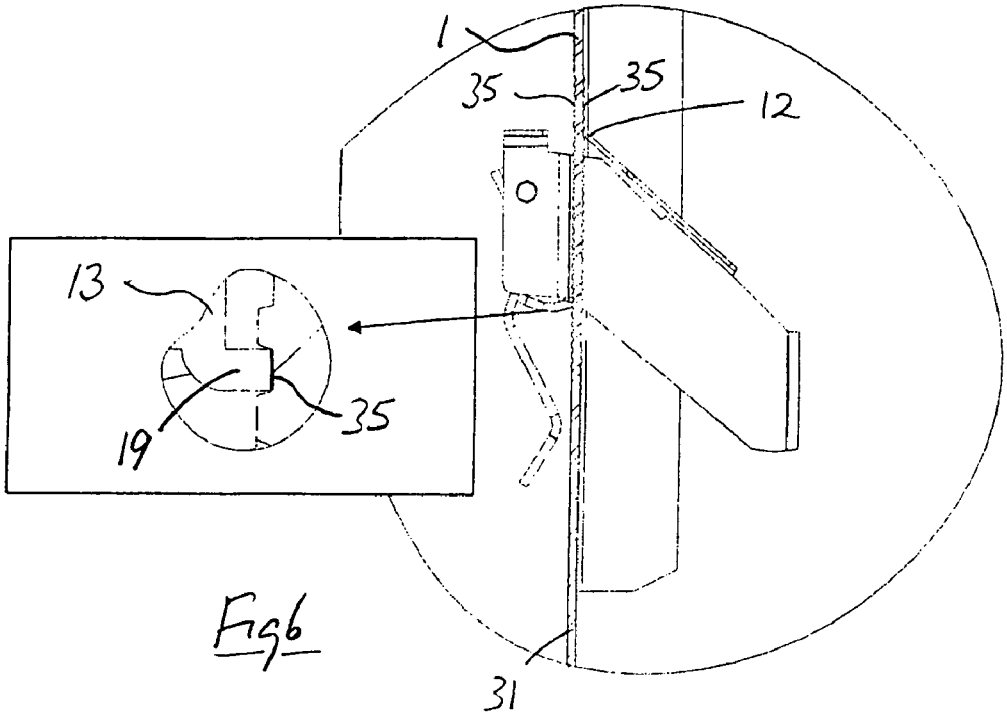
FIG. 6 is a side view of the locking assembly inserted in the mounting slot, after the clamping step.

Release of the extensions 15, 15' permits the recovery of the spring and the legs to resile apart so that the teeth 12 overlie aligned serrations 35 on the outer surface of the housing and, the locking feet 19 overlie those on the inside of the housing. In this state, as shown in FIG. 5, the outside surfaces of the legs 9,9' are in frictional sliding engagement with the slot edges enabling the clip to stay, temporarily in a selected position reached by sliding the latching assembly down the slot until the bottom edge of the foot 8 engages the upper surface of the ceiling 37. The handle 27 is then pivoted towards the inside wall surface of the housing, thrusting the locking tongue 28 progressively between the legs 9,9', pivoting the clip so that the feet 19 are drawn to seat immovably in aligned locking grooves 35 and, the teeth 12,12' are drawn with some resilient flexure against the serrations on the outer surface of the housing until opposite edges of the tongue 28 wedge between the opposed surfaces of the legs 9,9', clamping the locking assembly in position, as shown in FIG. 6.

Upward pivoting of the handle withdraws the locking tongue, unclamping the locking assembly to enabling readjustment of the position thereof by sliding up or down the vertical slot.

It will be noted that in the clamped position, the edge portions 10,10' combine with a lower edge 20 of the base 8 to form a foot with a continuous, U-shape edge-line of engagement with the ceiling when clamping the housing thereagainst, as shown in FIGS. 8 and 9A.

The invention claimed is:

1. A recessed lighting fixture comprising:

a box-like housing having a sidewall extending downward to a lower housing aperture and terminating in a lip extending outwardly around at least a portion of a perimeter of the aperture, the sidewall being formed with a slot extending away from the aperture and having a laterally enlarged portion; friction surface means on both opposite surfaces of the housing sidewall adjacent longitudinal edge portions of the slot, and, a housing locking assembly positionable in the slot at a preselected height to mount the housing in an opening in a ceiling so that the housing extends into the space above the ceiling and the lip extends around a lower edge of the ceiling opening, wherein:

the locking assembly comprises a support member and a latching member;

the support member being formed in one piece with a lower strut portion and an upper attachment portion;

the strut portion comprising a channel shape, ceiling engaging portion having a base from opposite side edges of which a pair of channel walls forming strut legs extend upwards in face-to-face relation with major portions extending obliquely of a channel axis and minor portions of lower edges of the channel walls adjacent a lower axial end of the base extending perpendicularly to the channel axis so as to combine with a lower axial edge of the base to provide a ceiling engaging foot with a continuous, U-shape edge-line of engagement with the ceiling, and, the strut portion further comprising a pair of flanges extending outwards from upper edge portions of the channel walls remote from the ceiling engaging foot and having toothed upper edges;

the upper attachment portion comprising a pair of flanges extending outwards from upper ends of the channel walls which form strut legs, providing shoulders extending parallel to the base, respective front edge portions of the shoulders being bent downwards to form housing locking feet;

the latching member being formed in one piece with an upper land having a front end with an elongate finger-piece handle extending therefrom and a locking tongue extending therefrom with a tapering free end extending towards the legs, perpendicularly of the finger-piece handle;

the upper land of the latching member being pivotally connected to the support member so that the recessed lighting fixture can be mounted in a ceiling cavity by raising the housing through an opening in a ceiling until the lip engages the lower edge of the opening and introducing the locking assembly through the lower housing aperture into an interior of the housing, inserting the strut forming legs, base first, through the slot with the flanges of the strut portion passing through the laterally enlarged portion of the slot until the entire strut portion is located on the outside of the housing; adjusting the vertical position of the locking assembly by sliding along the slot away from the enlarged portion until the ceiling engaging foot is adjacent the upper surface of the ceiling, and the toothed upper edges of the flanges and the locking feet, respectively, overlie the friction surface means on an outer surface of the housing and the friction surface means on an inner surface of the housing, respectively, and then pivoting the handle towards an inside wall surface of the housing, thrusting the locking tongue progressively between the legs pivoting the locking assembly so that the feet are drawn immovably against the friction surface means on the inside wall surface of the housing and the toothed upper edges of the flanges are drawn with some resilient flexure immovably against the friction surface means on the inside wall surface of the housing with opposite edges of the tongue wedged between opposed surfaces of the legs, clamping the locking assembly and housing in position.

2. A recessed lighting fixture according to claim 1 wherein the friction surface means comprise grooves on the surfaces of the housing extending transversely of the slot.

3. A recessed lighting fixture according to claim 1 wherein the strut forming legs diverge apart as they extend away from the base so that leg portions remote from the base span a greater width than a transverse width of the slot, return spring means extending between the leg portions so that they can be manually squeezed together resiliently flexing the return spring means to permit insertion of the flanges through the enlarged portion of the slot, and, when released, return apart, aided by the action of the return spring means, to reside in frictional sliding engagement with respective opposed edges of the slot to enable sliding movement along the slot and unaided temporary retention in the slot in different selected longitudinal positions.

4. A recessed lighting fixture according to claim 3 wherein the flanges on the attachment portion have respective upwardly bent extensions in parallel, face to face relation, providing a yoke formed with aligned through-sockets rotatively receiving a pivot pin and the return spring means comprises a spring coiled thereon, and outer rear ends of the extensions having locating tabs bent towards each other with free ends thereof overlapping in sliding engagement;

the land on the latching member having opposite sides formed with a pair of spaced apart, flange-form ears having through-sockets freely receiving the pivot pin thereby pivotally connecting the latching member to the support member, whereby the leg portions are manually squeezed together by engaging the upwardly bent extensions, the sliding engagement of the overlapping free ends of the tabs assisting in maintaining structural integrity during squeezing.

5. A recessed lighting fixture according to claim 4 wherein the locking tongue is struck from a central portion of the handle.

6. A recessed lighting fixture according to claim 4 wherein the toothed upper edges of the flanges of the strut portion comprise flat, tapering, resilient tooth forming extensions of the flanges.

* * * * *